US005531613A

United States Patent [19]

Takano et al.

[11] Patent Number: 5,531,613

[45] Date of Patent: Jul. 2, 1996

[54] CONNECTOR ATTACHMENT COMPONENT

[75] Inventors: Tsunesuke Takano; Kouichi Sinzawa, both of Tokyo, Japan

[73] Assignee: Daiichi Denso Buhin Co., Ltd., Japan

[21] Appl. No.: 254,076

[22] Filed: Jun. 6, 1994

[30] Foreign Application Priority Data

Jun. 15, 1993 [JP] Japan ..... 5-037573 U

[51] Int. Cl.[6] ..... H01R 13/73

[52] U.S. Cl. ..... 439/544; 439/553; 439/619

[58] Field of Search ..... 439/56, 549, 550, 439/552, 553, 557, 617, 619, 611, 544

[56] References Cited

U.S. PATENT DOCUMENTS

| | | | |
|---|---|---|---|
| 3,989,343 | 11/1976 | Zucius et al. | 439/557 |
| 4,740,173 | 4/1988 | Justiano et al. | 439/744 |
| 4,909,759 | 3/1990 | Fitzgerald et al. | 439/557 |
| 5,049,092 | 9/1991 | Takano et al. | 439/540 |
| 5,131,867 | 7/1992 | Peloza et al. | 439/552 |

FOREIGN PATENT DOCUMENTS 53-1825 1/1978 Japan .

*Primary Examiner*—David L. Pirlot
*Attorney, Agent, or Firm*—Nixon & Vanderhye

[57] ABSTRACT

A connector assembly for electrical components includes an electrically insulative base member having a generally square tubular form so as to establish a lengthwise interior space having open forward and rearward ends. The base member has a rearward constricted portion with a lesser widthwise dimension as compared to a forward base portion so as to establish at least one lateral recess rearwardly of the forward base portion of the base member. At least one electrically conductive connector having a pair of opposed forwardly projecting resilient conducting clamps is inserted into the rearward end of, and positioned within, the interior space of the base member so that a connection end of an electrical component may be inserted into the forward end of the interior space and held between the conducting clamps of the connector. The connector includes an insertion connection piece integrally connected, and laterally positioned relative, to the connector so that the insertion connection piece of the connector is disposed within the established recess rearwardly of the forward base portion.

4 Claims, 11 Drawing Sheets

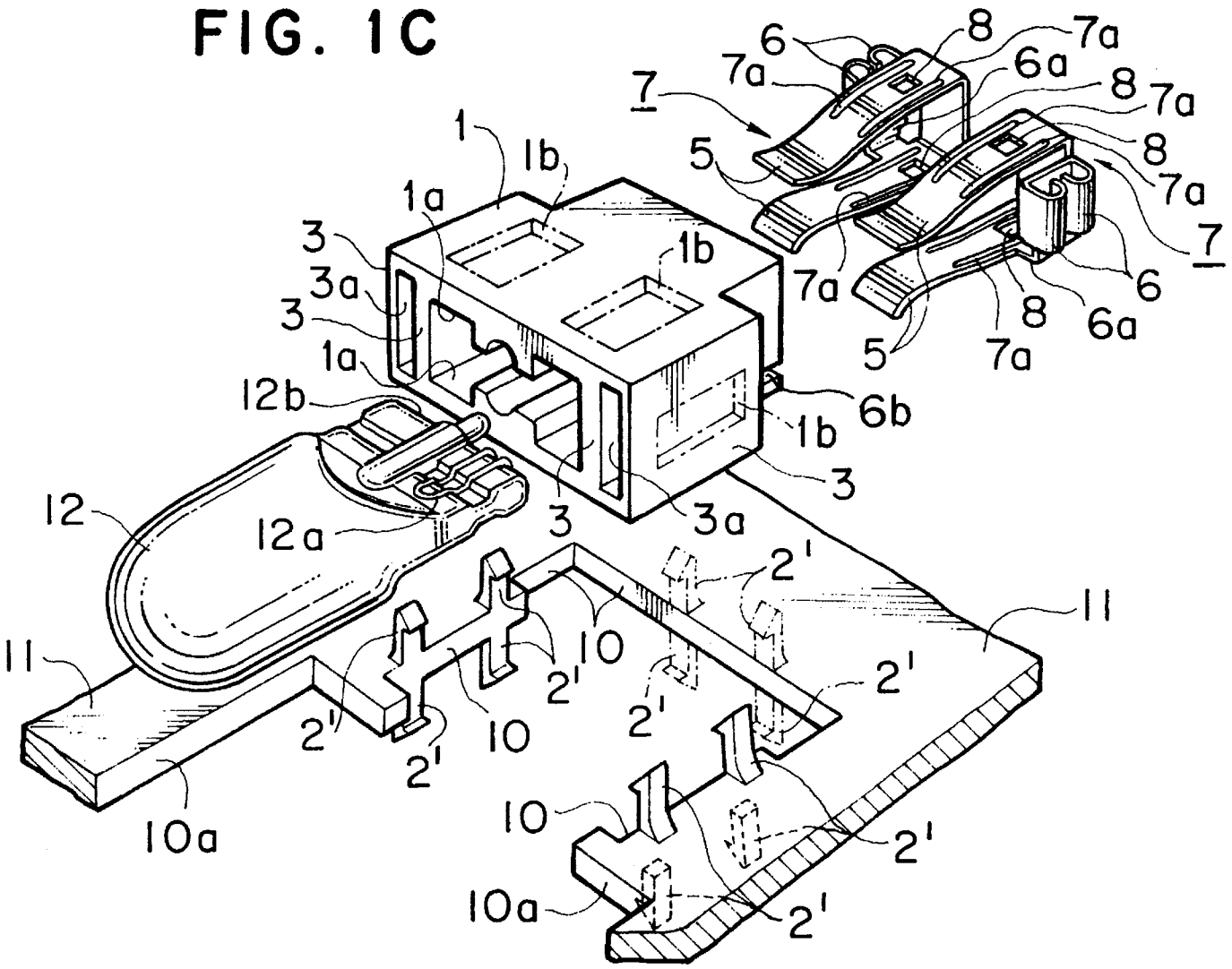
7
7a
8
7a
6
6a
8
7a
5
6b
1b
3
3a
3
1b
1
1a
3
3a
3
1a
12b
12a
12
11
10
10
10a
10a
11
2'
2'
2'

CONNECTOR ATTACHMENT COMPONENT

FIELD OF THE INVENTION

The present invention relates to a connector attachment component wherein a wedge base bulb and flat fuse are attached to an attaching member together with a connector via a heat-resistant flat holder.

BACKGROUND OF THE INVENTION

An example of a small lamp using a wedge base bulb of the prior art is described in Japanese Examined Utility Model Publication No. 53-1825.

This example of the prior art is a small interior lamp for automobile use equipped with a housing, a lens located in the opening of the housing, a holder attached to the housing, and a wedge base bulb supported in the holder. The holder is composed of a holder body, formed by bending a conductive metal strip into the shape of the letter "U", and an attachment piece integrated into a single unit with the holder body and extending in the opposite direction from the U-shaped conductive metal strip. An engaging indentation is formed with the holder body in the housing. A center piece and right and left side pieces are provided in opposition at an interval protruding from the top and bottom of the engaging indentation. The U-shaped portion of the holder body is clamped between the center piece and the left and right side pieces by fitting into the engaging indentation wherein the holder body is formed in the housing. In this state, the attachment piece of the holder body is fixed in the housing together with a conducting strip for connection.

Since the prior art described above comprises an interior lamp by directly forming a wedge base bulb portion in a portion of an interior lamp housing and inserting a connector, looseness occurs due to thermal deformation of the bulb holder caused by the generation of heat accompanying lighting of the above-mentioned bulb. Although the above-mentioned bulb holder portion should be molded with heat-resistant plastic together with a large-volume housing in order to prevent this loosening, this results in the first disadvantage of the prior art wherein the use of heat-resistant plastic is both expensive and difficult to mold, thus resulting in high costs.

In addition, the prior art also had the second disadvantage of the connector peripheral members, such as the above-mentioned bulb holder, having a complex structure, which together with requiring post-processing such as caulking, made automated insertion of the connector as well as automated assembly of the interior lamp by automated wiring extremely difficult.

SUMMARY OF THE INVENTION

In order to eliminate each of the above-mentioned problems, the object of the present invention is to obtain an inexpensive and reliable heat-resistant structure by attaching a wedge base bulb to a relatively large non-heat-resistant member via a relatively small heat-resistant holder, as well as allow automation of mounting of the above-mentioned holder to an attaching member, including attachment of a connector to said holder.

U.S. Pat. No. 5,049,092 discloses an insertion connection piece which is located at the back of a connector. Connection with a tab terminal or BUS bar from the lengthwise direction of a bulb holder is therefore possible.

However, connection of the bulb holder in the lengthwise direction with a tab terminal or BUS bar in the perpendicular direction was difficult.

The above-mentioned object of the present invention is accomplished by a bulb holder having two connectors, respectively equipped with a pair of clamps formed of a resilient U-shaped conductive strip, and an insertion connection piece on its base portion, which are integrated into a single unit. The connectors are respectively mounted in parallel via a pair of projections formed on opposing upper and lower surfaces of an insulating base in the shape of a square cylindrical frame between the opposing surfaces at an attachment hole formed in the base portion of said clamp. The holder is mounted to an attaching body which defines a mounting hole slightly larger than the planar contour of the insulating base by the locking tabs at the edges of said mounting hole.

When the outer surfaces of the locking tabs of the insulating base are pressed between the edges of the mounting hole of the attaching body, after the sides of the insulating base are pushed in the direction in which the side relief holes become narrower in opposition to the their resiliency, the sides are locked with a single snapping action as they return to their original state as a result of the locking tabs being released from the edges of the mounting hole, thus allowing the bulb holder to be easily mounted to the attaching body at its mounting hole.

When in this mounted state, the movement in the vertical direction of the insulating base with respect to the attaching body is restricted since the opposing hook edges of the pair of locking tabs are making contact with the respective upper and lower surfaces of the attaching body, thus preventing the occurrence of rattling. In addition, horizontal movement of the insulating body is restricted with the peripheral edges of the mounting hole of the attaching body, thus also preventing rattling.

Thus, since the insertion connection piece is located on the side edge of a connector, the bulb holder can be connected in the lengthwise direction with a tab terminal and BUS bar from the perpendicular direction.

As a result of forming an insertion connection piece, having a pair of clamps and insertion connection piece, into a single unit with a single connector, a wedge base bulb can be used by tightly clamping with a pair of clamps, and a tab terminal and BUS bar can be connected by tightly inserting into said insertion connection piece.

Since the connector attachment component, namely the bulb holder, is surrounded by a heat-resistant insulating base, two connectors can be mounted with favorable compatibility, irrespective of conductive plates and non-heat-resistant insulating plates, via this insulating base.

BRIEF DESCRIPTION OF THE ACCOMPANYING DRAWINGS

FIG. 1C is an exploded perspective view of another embodiment of the apparatus of the present invention.

DETAILED DESCRIPTION OF THE PREFERRED EXEMPLARY EMBODIMENT

The following provides an explanation of the embodiments of the present invention with reference to the drawings.

Figure 1A:
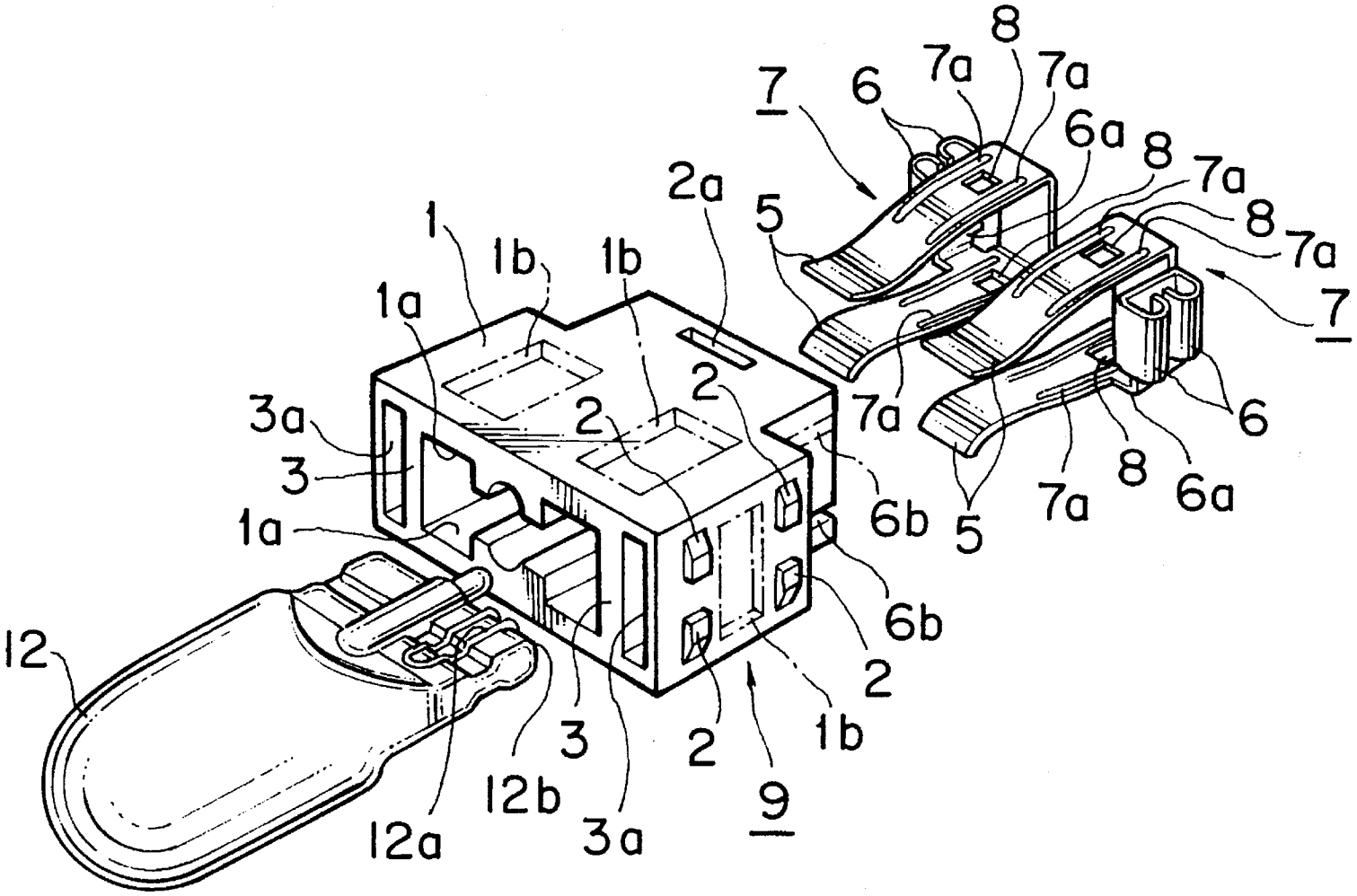
FIG. 1A is an exploded perspective view of the apparatus of the present invention.
Figure 1B:
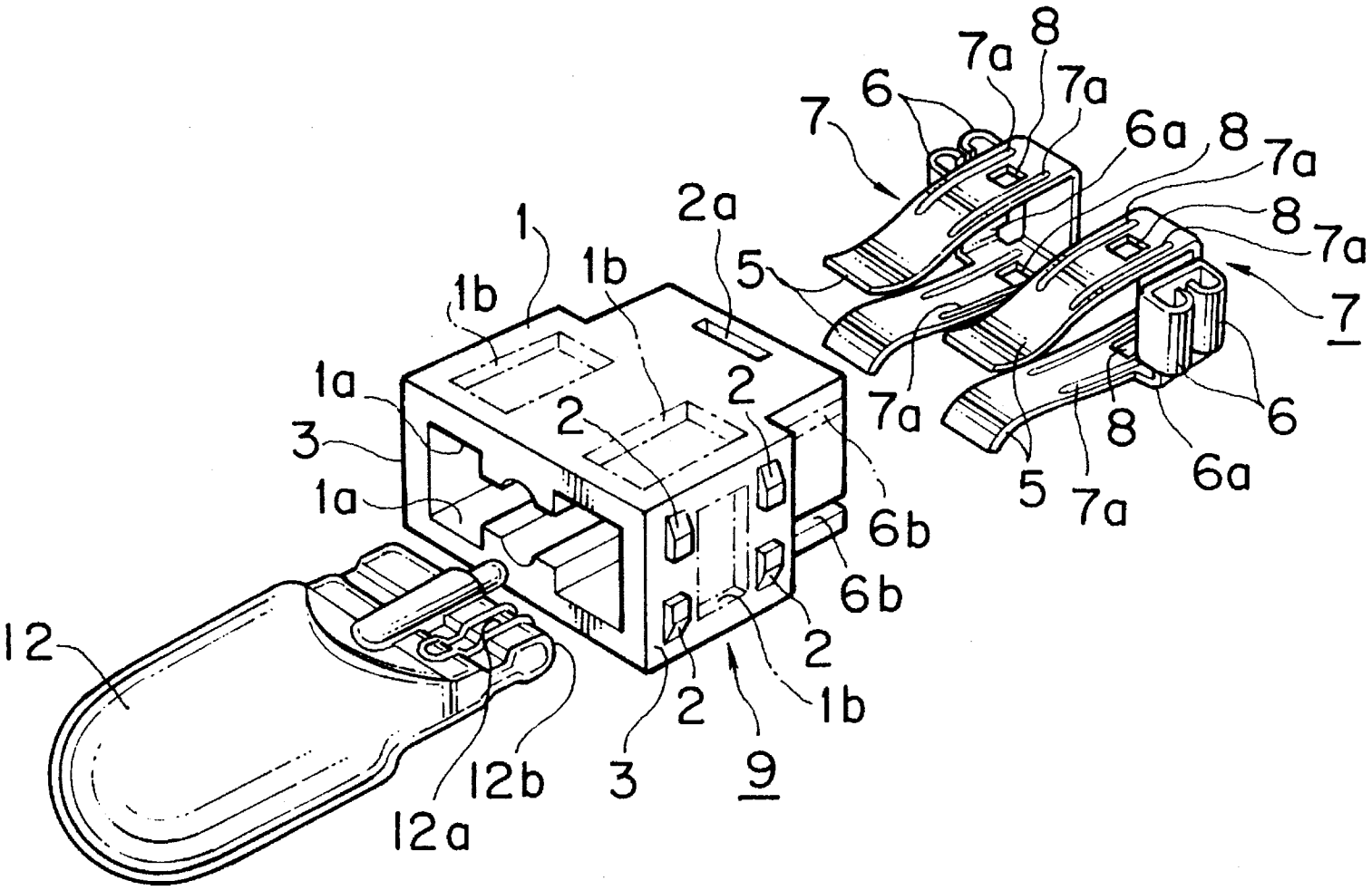
FIG. 1B is an exploded perspective view of another embodiment of the apparatus of the present invention.

First, with respect to the basic constitution of the present invention, in the composing of a connector attachment component used for attaching an insulated holder, to which a connector is attached, to an attaching member, for example 2 pairs for a total of 4 locking tabs 2 are molded with a known three-way opening and closing mold as shown in FIG. 1A onto the top and bottom of the right and left sides of insulating base 1 formed from a heat-resistant plastic such as Nylon 66 into an inverted T-shaped square cylindrical frame as is also shown in FIG. 1A.

Figure 4:
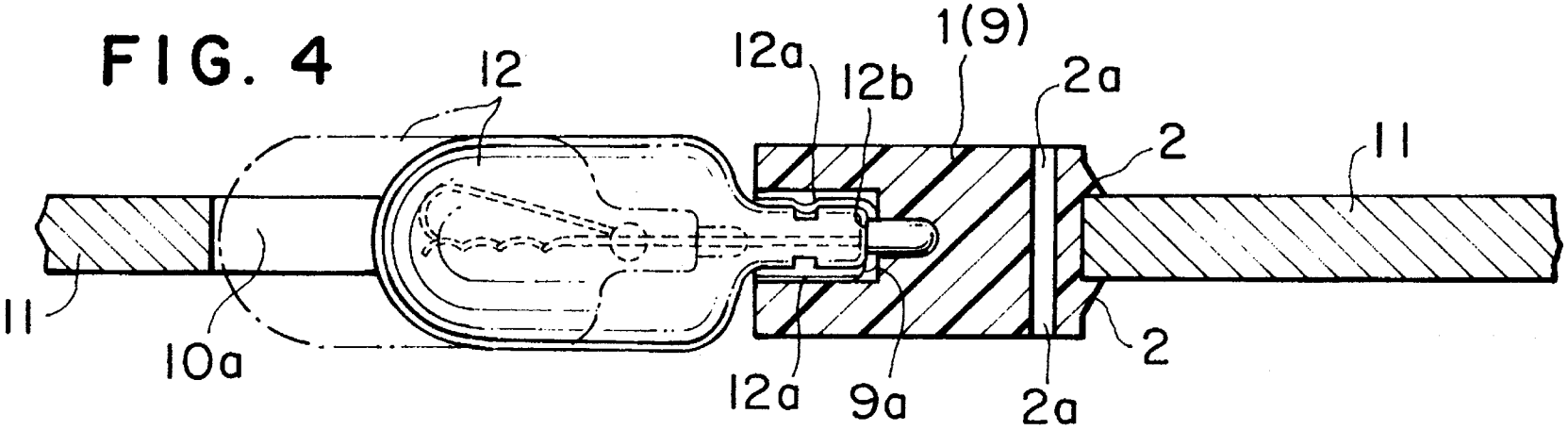
FIG. 4 is a cross-sectional view taken along line B—B of FIG. 2.
Figure 6:
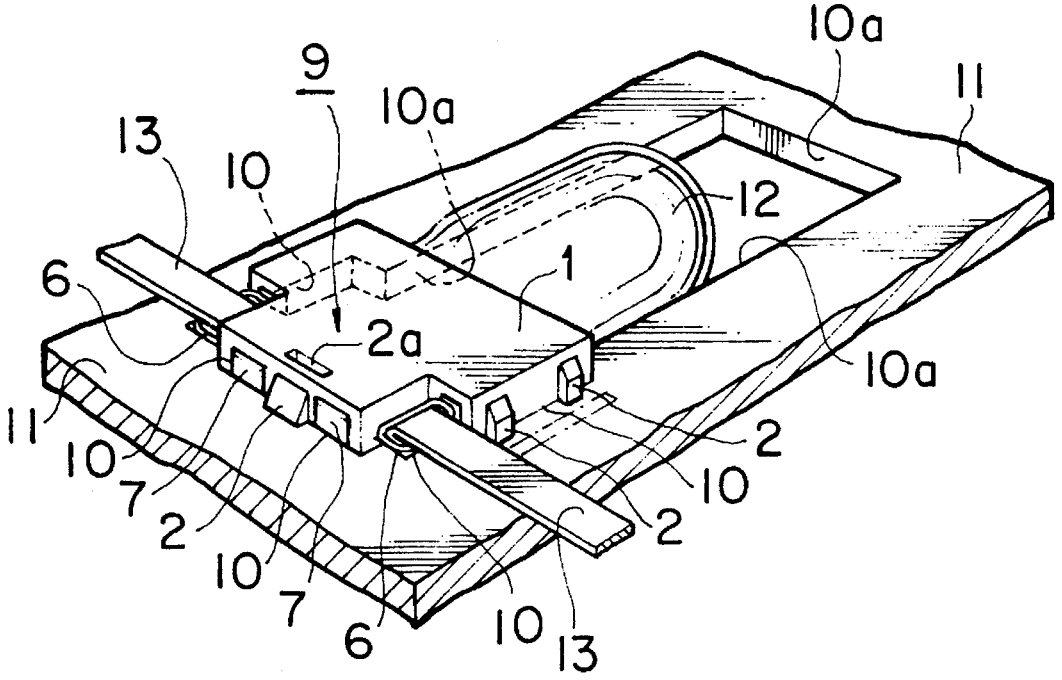
FIG. 6 is a perspective view showing an example of use of the apparatus of the present invention.

Furthermore, upper and lower opposing locking tabs 2 may be formed together with rear surface relief hole **2*a* in the rear surface of base 1 as necessary as shown in FIG. 4, and lock resiliently with the hole edge of attaching body 11** as shown in FIGS. 4 and 6.

Figure 2:
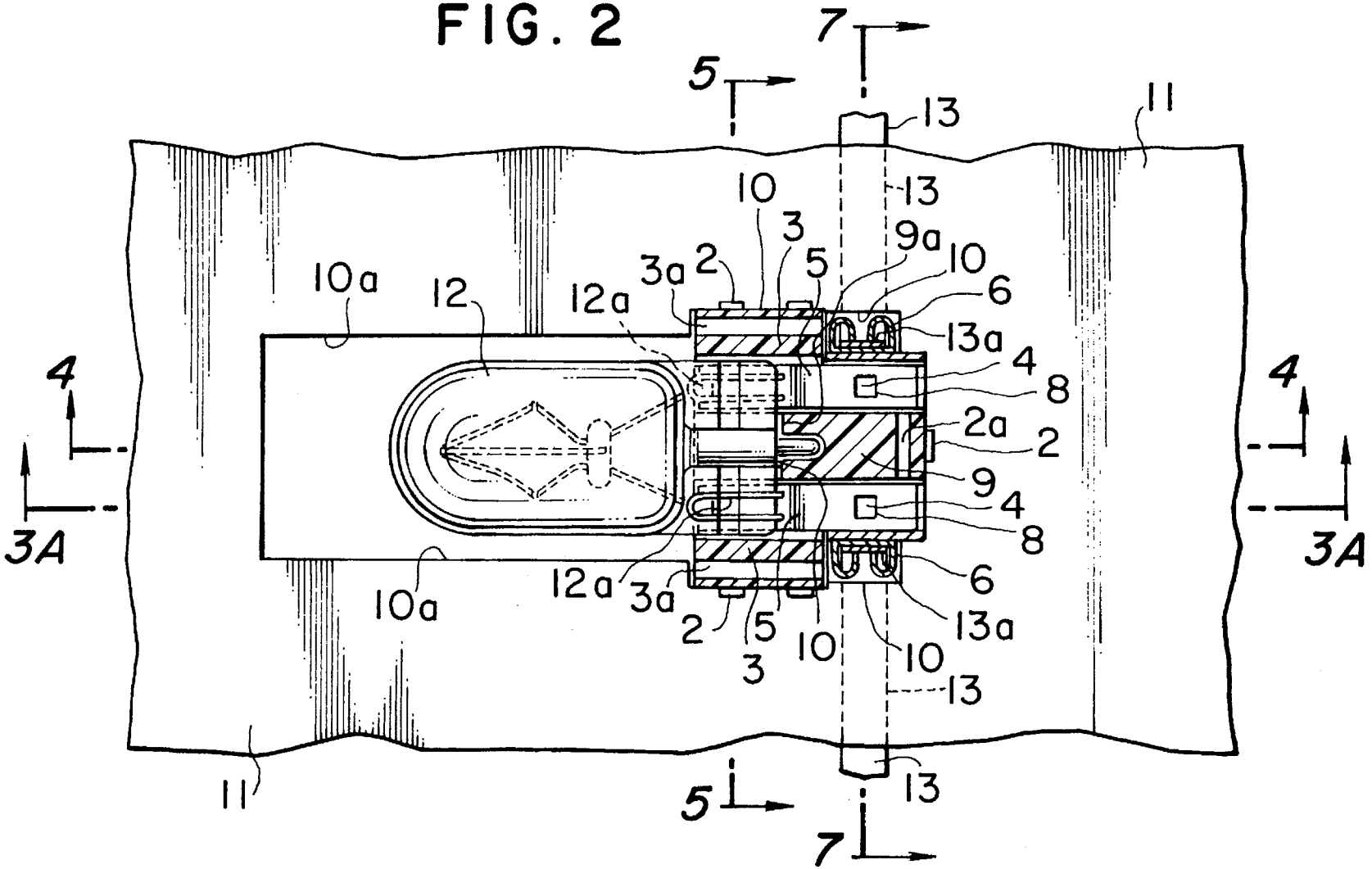
FIG. 2 is a cross-sectional overhead view of the apparatus of the present invention.
Figure 3A:
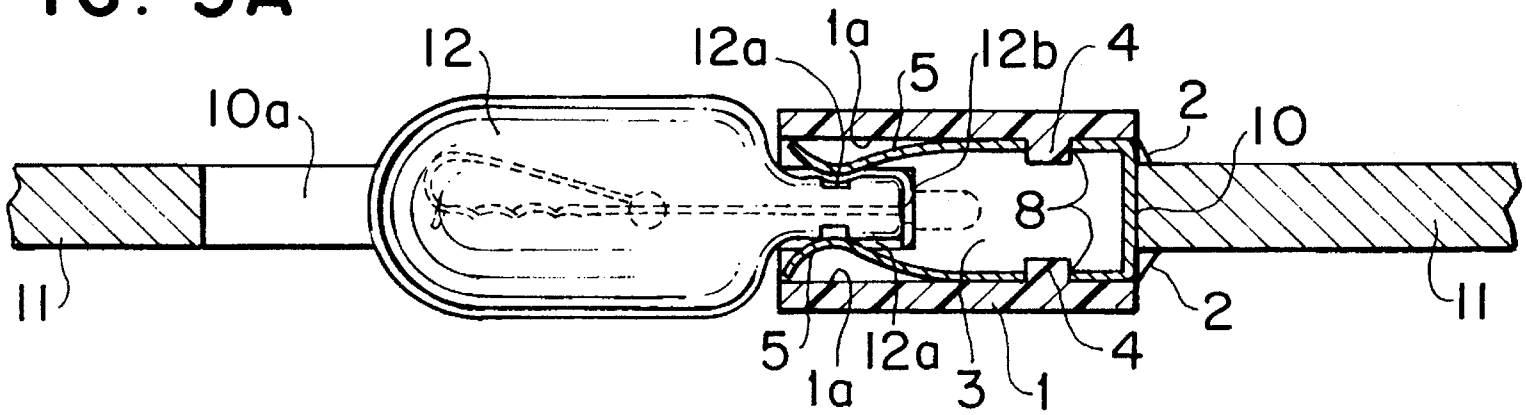
FIG. 3A is a cross-sectional view taken along line A—A of FIG. 2.

Projections 4 protrude in opposition as shown in FIG. 3A from opposing surfaces 1 a on the top and bottom of insulating base 1 between opposing side pieces 3 formed separated by long, narrow side relief holes **3*a*, respectively, from the inside surfaces of said sides on both sides in the direction of width of said insulating base 1** as shown in FIGS. 1A and 2.

Figure 3B:
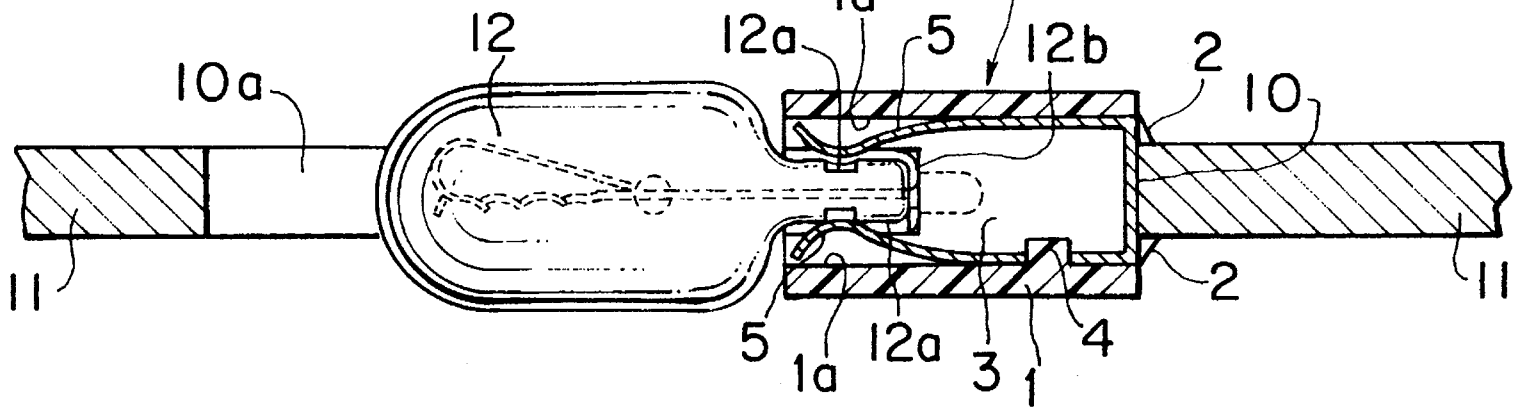
FIG. 3B is a cross-sectional view of an example having one projection 4.

In addition, side relief holes **3*a* are not always necessary, but rather side relief holes 3*a*** may not be provided as shown in FIG. 3B.

Figure 1D:
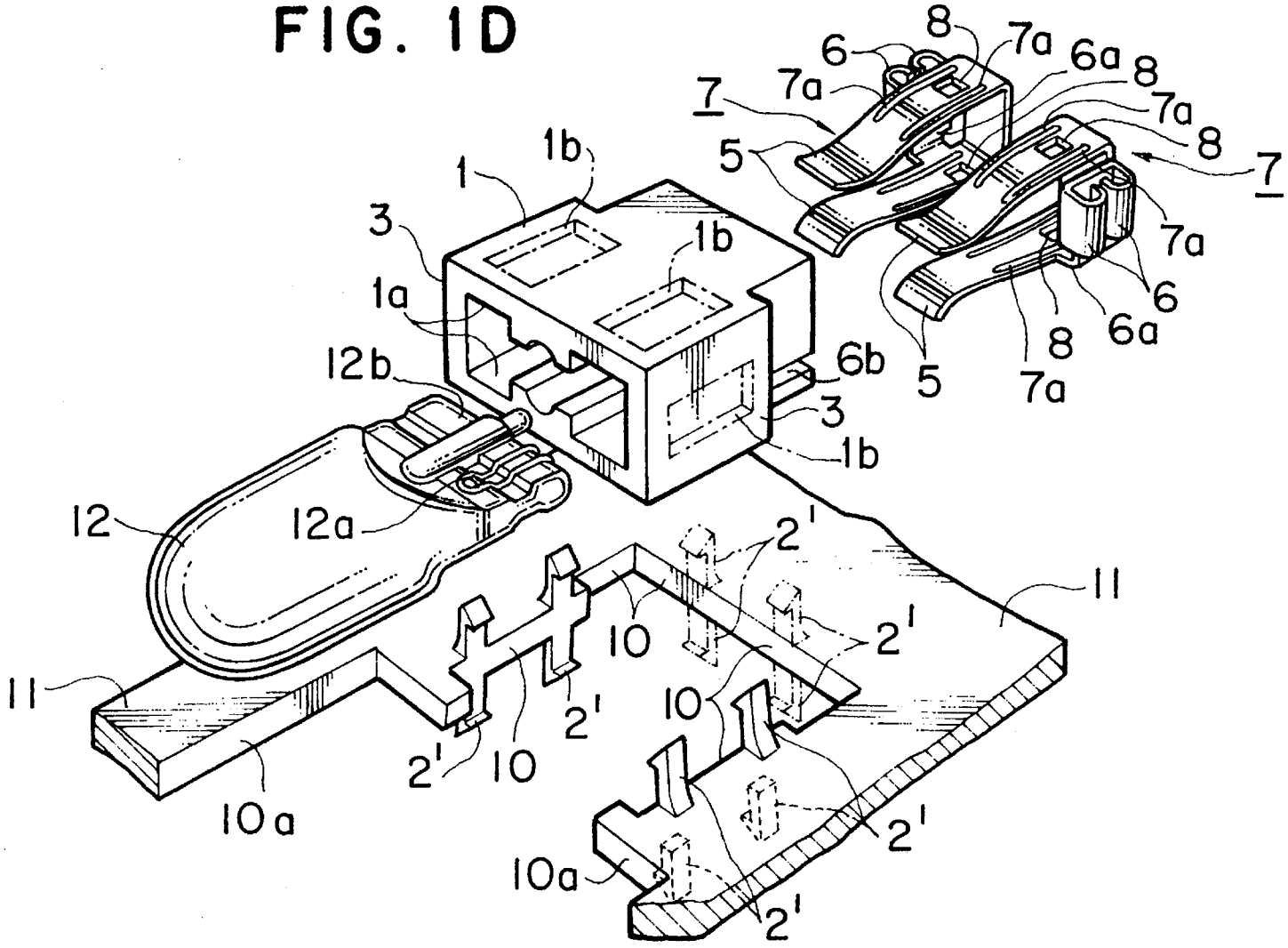
FIG. 1D is an exploded perspective view of another embodiment of the apparatus of the present invention.
Figure 1E:
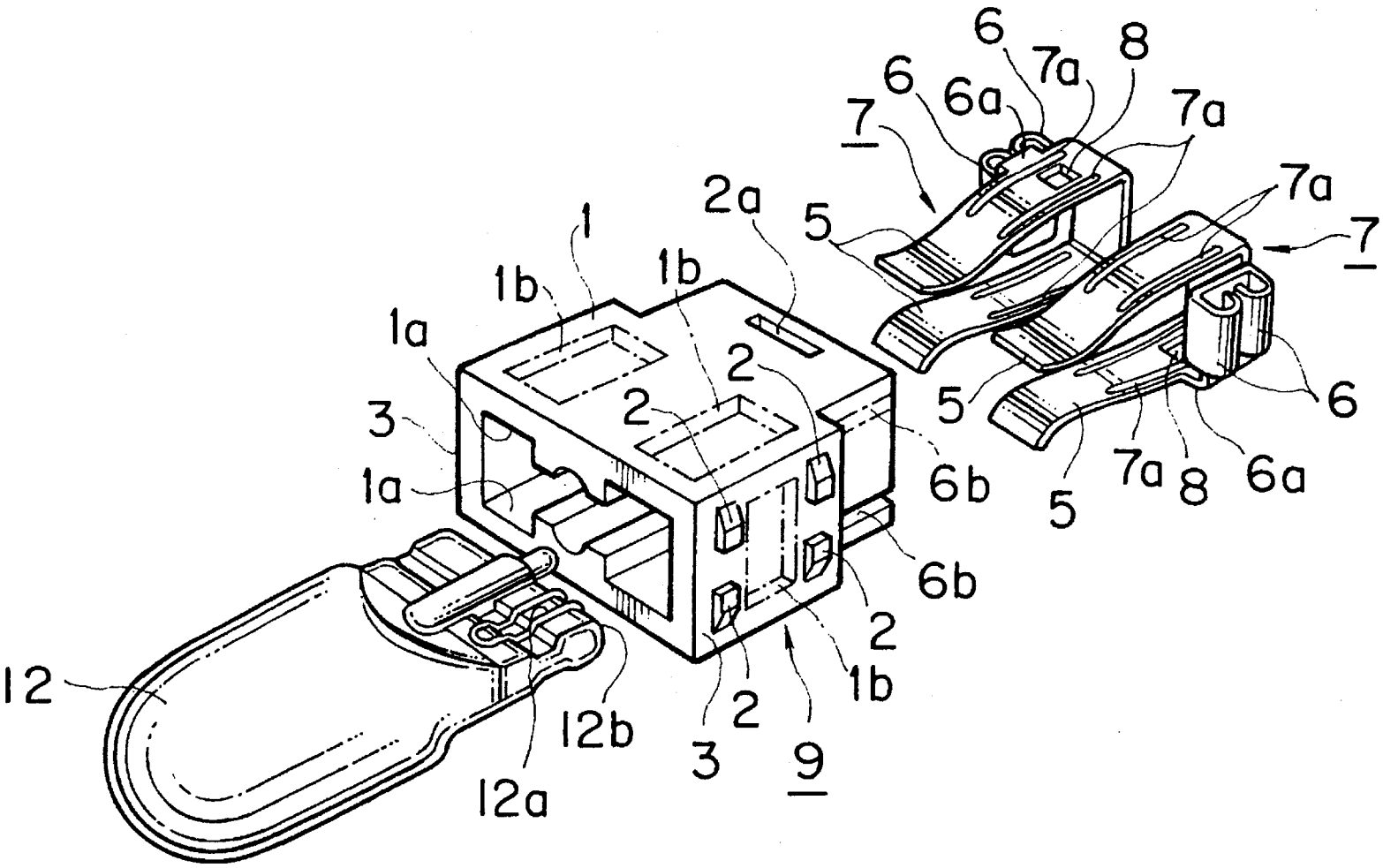
FIG. 1E is an exploded perspective view of another embodiment of the apparatus of the present invention.
Figure 1F:
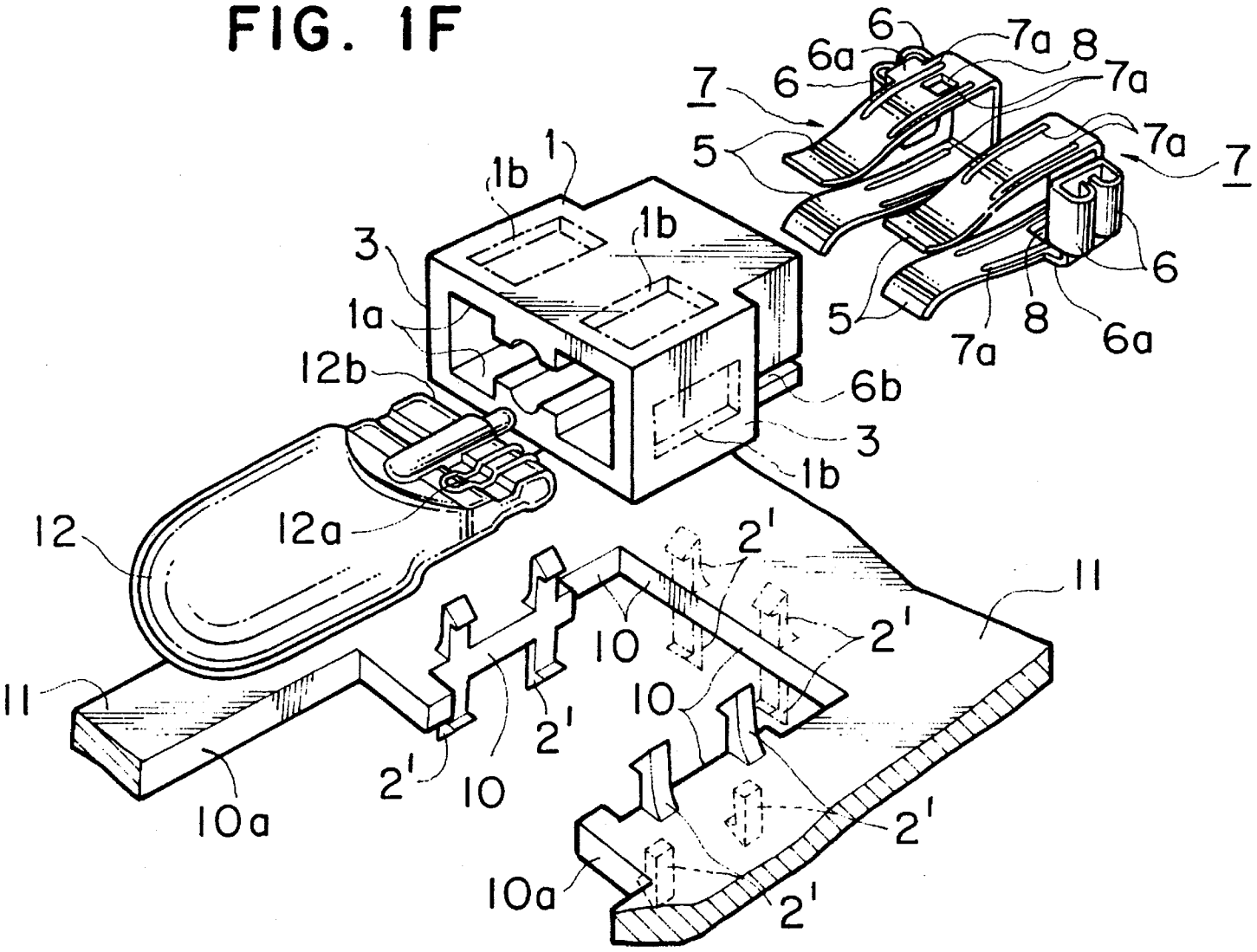
FIG. 1F is an exploded perspective view of another embodiment of the apparatus of the present invention having a single attachment hole in the connectors.

Moreover, only one of projection 4 may be provided either on the top or bottom as shown in FIGS. 1E, 1F and 3B.

In addition, two connectors 7, respectively equipped with a pair of clamps 5, wherein resilient conductive strips made of phosphor bronze and so forth are formed into roughly the shape of the letter "U" as shown in FIG. 1A, and eyeglass-shaped insertion connection piece 6 formed on rising base **6*a* on its side edge, integrated into a single unit, are clamped within the above-mentioned insulating base 1** as shown in FIGS. 3A through 5.

Namely, bulb holder 9 is composed at this time by inserting rising base **6*a* of connection piece 6 into base side groove 6*b* while inserting said clamps 5 between opposing surfaces 1 a while becoming narrower in opposition to their resiliency, fitting the above-mentioned pair of projections into attachment holes 8 formed in the connection piece base with the snapping action of their resilient return, and respectively mounting the above-mentioned connectors 7 between base opposing surfaces 1*a*** as shown in FIG. 3A.

Furthermore, by using a constitution that provides two protruding ribs **7*a* on the above-mentioned connectors 7** as shown in FIG. 1A, clamping resiliency is strengthened and heat radiation is improved.

Moreover, the connector attachment component according to the present invention is then composed by mounting the above-mentioned bulb holder 9 to attaching body 11, in which is formed mounting hole 10, slightly larger than the planar contour of the above-mentioned insulating base 1, and auxiliary hole **10*a*, provided in conjunction with this mounting hole 10 as shown in FIG. 6, at said mounting hole 10 in attaching body 11 by the above-mentioned locking tabs 2** by utilizing their tapered surfaces and so forth as shown in FIG. 6 and each of the above-mentioned drawings.

Figure 8:
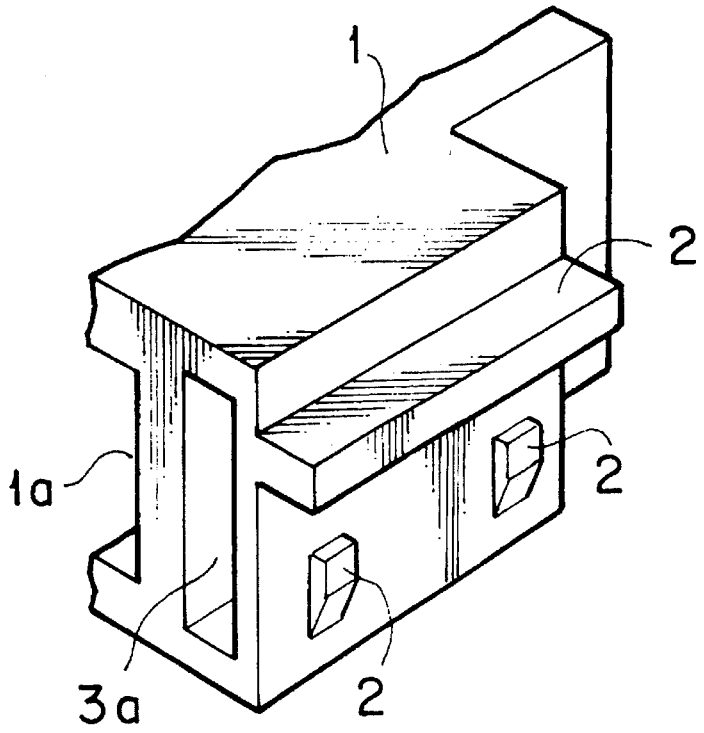
FIG. 8 is a perspective view of the essential portion showing another example of the locking tabs.
Figure 9:
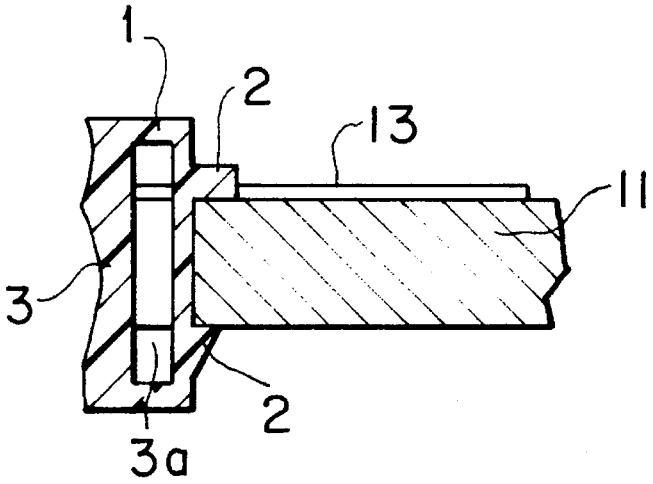
FIG. 9 is a partial cross-sectional view showing an example of locking the above.

Furthermore, bulb holder 9 may also be mounted in attaching body 11 as shown in FIG. 9 with hood-shaped projection 2 for the upper tabs of locking tabs 2, and lower projection 2 in opposition to this projection 2 as shown in FIG. 8.

In addition, locking tabs 2 may also be provided on the attaching body in the form of locking tabs 2' as shown in FIGS. 1C and 1D.

The following provides an explanation of an example of use of the present invention.

Figure 5:
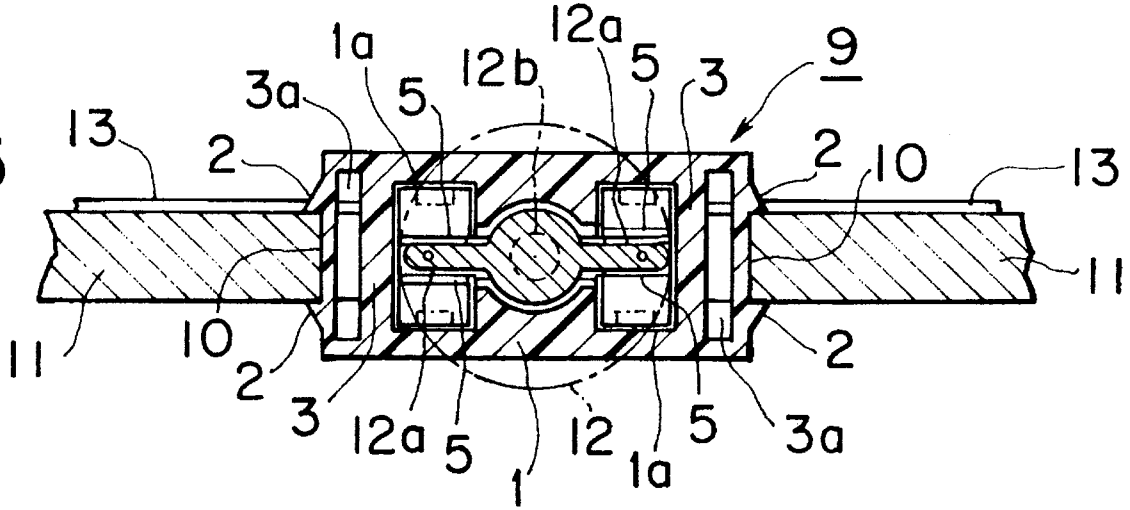
FIG. 5 is a cross-sectional view taken along line C—C of FIG. 2.

Although a known wedge base bulb 12 as shown in FIG. 1A is inserted into bulb holder 9 at its base portion from the state indicated by the broken line of FIG. 4 as shown by the solid line of that same drawing as well as FIGS. 3A and 5, at this time, bulb 12 can be inserted into holder 9 as shown in each of the above-mentioned drawings by first inserting until bulb base **12*b* makes contact with holder ledge 9*a* while pushing apart clamps 5 of connectors 7 at lead portions 12*a* of bulb 12** in opposition to their resiliency.

Figure 7:
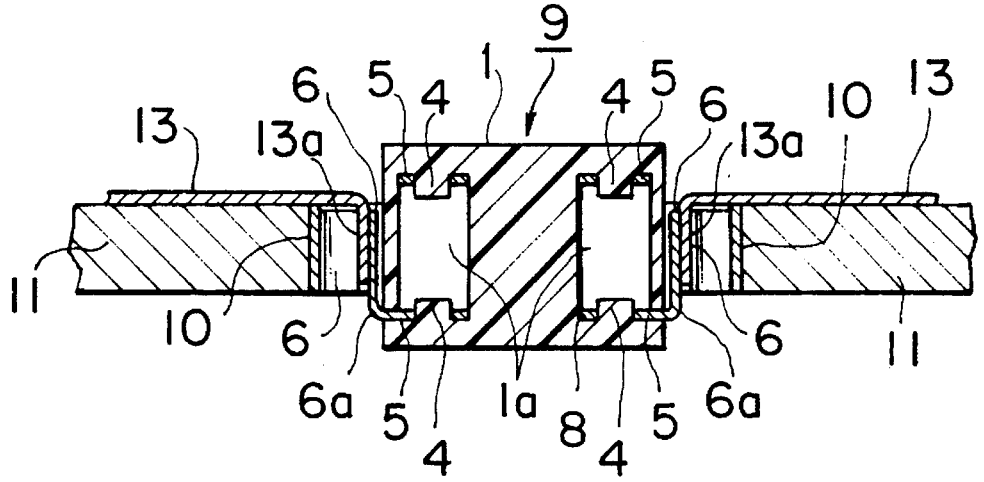
FIG. 7 is a cross-sectional view taken along line D—D of FIG. 2.

Next, wedge base bulb 12 can then be lit by tightly inserting BUS bars 13, arranged along the surface of attaching body 11 as shown in FIGS. 2 and 7, into insertion connection pieces 6 of connectors 7 at their bent portions **13*a*** resulting in electrical continuity.

Furthermore, although a known flat fuse may be inserted in place of the above-mentioned wedge base bulb 12, bulb holder 9 should then be read instead as a fuse holder at that time.

Thus, since the heat resistance requirements around the lamp can be satisfied by only making bulb holder 9, having a small volume, of expensive heat-resistant plastic while making large attaching body 11 from inexpensive plastic, a considerable reduction in costs can be realized in comparison with the above-mentioned prior art, thus offering a first advantage of the present invention with respect to being economical.

When in this mounted state, since the movement in the vertical direction of insulating base 1 with respect to attaching body 11 is restricted since the opposing hook edges of the pair of locking tabs 2 respectively make contact with the upper and lower surfaces of attaching body 11, there is no rattling.

Since locking tabs 2 formed in insulating base 1 that composes bulb holder 9 are formed rigidly into a single unit without moving with respect to base 1, there is no indiscriminate movement of the insulating base after mounting to the attaching body.

In addition, since connectors 7 are surrounded by insulating base 1 in the assembled component of connectors 7, two connectors 7 can be mounted via insulating base 1 with favorable compatibility irrespective of conducting plates or insulating plates, thus offering a second advantage of the present invention.

In addition, since insulating base 1 is of relatively small size and only requires the use of a small amount of plastic, together with costs being low enough to allow adequate profitability even if formed from expensive heat-resistant plastic, since the use of expensive heat-resistant plastic is not particularly required for a relatively large insulating plate for attaching, costs are ultimately low overall, thus offering a third advantage of the present invention.

Moreover, since a pair of clamps 5 and an insertion connection piece 6 having an insertion connection portion are formed by integrating into a single unit in a single connector, the present invention can be carried out while saving on space and at reduced costs in terms of conservation of resources. Moreover, together with a wedge base bulb and so forth being able to be tightly clamped with a pair of clamps 5, since a tab terminal and BUS bar can be connected by directly and tightly inserting into insertion clamp piece 6, the caulking tools and so forth required in the prior art are not necessary. Thus, assembly can be automated and connection work can be performed easily even in confined or dark locations such as the engine room of an automobile, thus offering a fifth advantage of the present invention.

Moreover, since the insertion connection piece is located on the side edge of the connector, the bulb holder can be connected in the lengthwise direction with a tab terminal and BUS bar in the perpendicular direction.

What is claimed is:

1. A connector for an electrical component comprising:

(A) an electrically-insulated base formed of a heat-resistant plastics material and having a generally square tubular shape;

said base including a rearward constricted portion having a lesser widthwise dimension as compared to a forward portion of said base so as to establish a pair of lateral recesses rearwardly of said forward portion of said base;

a pair of protruding locking tabs protruding from sides of said forward portion of said insulating base;

said forward portion of said base including a pair of side relief holes extending in a lengthwise direction interiorly adjacent said sides of said forward portion;

at least one pair of projections protruding from opposed upper and lower interior surfaces of said rearward portion of said base;

(B) a pair of resilient generally U-shaped connector each having a pair of clamps formed of a resilient electrically conductive strip, said connector clamps being inserted into said rearward portion of said base so that said connector clamps face forwardly to receive a connection end of an electrical component inserted into the forward portion of said base; wherein each of said connector clamps includes, (I) at least one attachment hole which receives a respective one of said projections when said connector clamp is inserted into said rearward portion of said base, and (II) an insertion connection piece integrally connected, and laterally positioned relative, to said connector clamp so that said insertion connection piece of said connector clamp is disposed within one of said established recesses rearwardly of said forward portion of said base when said connector clamp is inserted into said rearward portion of said base; and (C) an attaching body having a mounting aperture formed slightly larger than a perimetrical outline of said insulating base, said base being received within said mounting aperture, wherein said attaching body includes locking tabs formed adjacent to said mounting aperture and sized so as to be engaged with said base and thereby couple said base to said attaching body.

2. The connector as in claim 1, wherein said base includes a pair of protruding side locking tabs protruding from the sides of said forward base portion so as to engage said mounting aperture of said attaching body.

3. The connector as in claim 1 wherein each of said connector clamps includes a vertical protruding rib formed thereon.

4. The connector as in claim 1 wherein each of said connector clamps includes only one attachment hole for receiving a respective one of said projections.

* * * * *